US011359523B2

(12) United States Patent
Lorenzon et al.

(10) Patent No.: US 11,359,523 B2
(45) Date of Patent: Jun. 14, 2022

(54) ACTUATION ARRANGEMENT FOR ACTUATING A LATCH IN A SWITCHABLE ROCKER ARM AND A VALVE TRAIN COMPRISING THE SAME

(71) Applicant: Eaton Intelligent Power Limited, Dublin (IE)

(72) Inventors: Alessio Lorenzon, Avigliana (IT); Emanuele Raimondi, San Francesco al Campo (IT); Nicola Andrisani, Cumiana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/492,176

(22) PCT Filed: Oct. 24, 2017

(86) PCT No.: PCT/EP2017/077213
§ 371 (c)(1),
(2) Date: Sep. 9, 2019

(87) PCT Pub. No.: WO2018/162095
PCT Pub. Date: Sep. 13, 2018

(65) Prior Publication Data

US 2021/0189917 A1 Jun. 24, 2021

(30) Foreign Application Priority Data

Mar. 9, 2017 (GB) ..... 1703798

(51) Int. Cl.
*F01L 13/00* (2006.01)
*F01L 1/047* (2006.01)
*F01L 1/18* (2006.01)

(52) U.S. Cl.
CPC ..... *F01L 13/0005* (2013.01); *F01L 1/047* (2013.01); *F01L 1/18* (2013.01); *F01L 1/182* (2013.01);
(Continued)

(58) Field of Classification Search
CPC . F01L 13/0036; F01L 1/185; F01L 2001/186; F01L 13/0005; F01L 2013/001;
(Continued)

(56) References Cited

U.S. PATENT DOCUMENTS 4,151,817 A 5/1979 Mueller
4,556,025 A 12/1985 Morita
(Continued)

FOREIGN PATENT DOCUMENTS

CN 101299969 B 4/2011
CN 105121090 A 12/2015
(Continued)

OTHER PUBLICATIONS

DE-102008059207, Jun. 2010, English Language Machine Translation.*

*Primary Examiner* — Patrick Hamo
*Assistant Examiner* — Wesley G Harris
(74) *Attorney, Agent, or Firm* — Mei & Mark, LLP

(57) ABSTRACT

A valve train assembly includes: at least one dual body rocker arm having a first body, a second body, and a latching arrangement for latching and unlatching the first body and the second body, the latching arrangement being biased to an unlatched configuration; and an actuator arrangement external to the rocker arm for controlling the latching arrangement, the actuator arrangement being arranged so that a default setting thereof is to cause the latching arrangement to be in a latched configuration.

20 Claims, 3 Drawing Sheets

(52) U.S. Cl.
CPC ..... *F01L 1/185* (2013.01); *F01L 13/00* (2013.01); *F01L 2001/186* (2013.01); *F01L 2013/001* (2013.01); *F01L 2305/00* (2020.05); *F01L 2800/12* (2013.01)

(58) Field of Classification Search
CPC ..... Y10T 403/7016; Y10T 403/7026; F16D 2001/103
USPC ..... 123/90.16, 90.39
See application file for complete search history.

(56) References Cited

U.S. PATENT DOCUMENTS

| | | | | |
|---|---|---|---|---|
| 5,022,645 | A * | 6/1991 | Green | B65H 5/021 271/276 |
| 5,417,186 | A * | 5/1995 | Elrod | F01L 13/0057 123/90.17 |
| 5,544,626 | A | 8/1996 | Diggs et al. | |
| 5,653,198 | A * | 8/1997 | Diggs | F01L 1/185 123/90.16 |
| 5,660,153 | A | 8/1997 | Hampton et al. | |
| 6,314,928 | B1 | 11/2001 | Baraszu et al. | |
| 6,769,387 | B2 | 8/2004 | Hayman et al. | |
| 7,704,254 | B2 | 4/2010 | Walen | |
| 8,348,951 | B2 | 1/2013 | Walen et al. | |
| 8,444,647 | B2 | 5/2013 | Walen et al. | |
| 8,696,673 | B2 | 4/2014 | Walen et al. | |
| 9,060,783 | B2 | 6/2015 | Walen et al. | |
| 9,445,822 | B2 | 9/2016 | Walen et al. | |
| 9,470,116 | B2 | 10/2016 | Cecur | |
| 9,745,875 | B2 | 8/2017 | Yano et al. | |
| 9,820,753 | B2 | 11/2017 | Walen et al. | |
| 9,869,211 | B2 | 1/2018 | Sheren et al. | |
| 9,995,183 | B2 | 6/2018 | Sheren et al. | |
| 10,196,943 | B2 | 2/2019 | Cecur | |
| 10,278,710 | B2 | 5/2019 | Walen et al. | |
| 10,550,739 | B2 | 2/2020 | Raimondi | |
| 11,090,061 | B2 | 8/2021 | Walen et al. | |
| 11,179,163 | B2 | 11/2021 | Walen et al. | |
| 2005/0274345 | A1* | 12/2005 | Dietz | F01L 1/053 123/90.17 |
| 2007/0119055 | A1 | 5/2007 | Walen et al. | |
| 2010/0064525 | A1 | 3/2010 | Walen et al. | |
| 2010/0228256 | A1 | 9/2010 | Walen et al. | |
| 2012/0291729 | A1* | 11/2012 | David | F01L 1/344 123/90.15 |
| 2013/0131680 | A1 | 5/2013 | Walen et al. | |
| 2014/0194882 | A1 | 7/2014 | Walen et al. | |
| 2015/0282814 | A1 | 10/2015 | Walen et al. | |
| 2017/0065285 | A1 | 3/2017 | Walen et al. | |
| 2017/0198613 | A1 | 7/2017 | Raimondi | |
| 2018/0070958 | A1 | 3/2018 | Walen et al. | |
| 2018/0163576 | A1 | 6/2018 | Sheren et al. | |
| 2019/0231364 | A1 | 8/2019 | Walen et al. | |
| 2021/0177433 | A1 | 6/2021 | Walen et al. | |

FOREIGN PATENT DOCUMENTS

| | | | | |
|---|---|---|---|---|
| CN | 106414918 | A | 2/2017 | |
| CN | 104395564 | B | 5/2017 | |
| DE | 102008059207 | A1 * | 6/2010 | F01L 1/185 |
| GB | 2309489 | A | 7/1997 | |
| GB | 2526554 | A * | 12/2015 | F01L 13/0005 |
| GB | 2526554 | A | 12/2015 | |
| JP | 3830197 | B2 | 10/2006 | |
| JP | WO2014030226 | A1 | 7/2016 | |
| WO | WO-2013156610 | A1 * | 10/2013 | F02M 26/01 |
| WO | 2014030226 | A1 | 2/2014 | |

* cited by examiner

ACTUATION ARRANGEMENT FOR ACTUATING A LATCH IN A SWITCHABLE ROCKER ARM AND A VALVE TRAIN COMPRISING THE SAME

CROSS-REFERENCE TO PRIOR APPLICATIONS

This application is a U.S. National Phase application under 35 U.S.C. § 371 of International Application No. PCT/EP2017/077213, filed on Oct. 24, 2017, and claims benefit to British Patent Application No. GB 1703798.7, filed on Mar. 9, 2017. The International Application was published in English on Sep. 13, 2018 as WO/2018/162095 under PCT Article 21(2).

FIELD

The invention relates to an actuation arrangement for actuating a latch arrangement in a switchable rocker arm and more specifically to an actuation system for guaranteeing a default latched configuration for the switchable rocker arm when the switchable rocker arm comprises a latch that is biased towards an unlatched configuration.

BACKGROUND

Internal combustion engines may comprise switchable engine or valve train components. For example, valve train assemblies may comprise a switchable rocker arm to provide for control of valve actuation (for example exhaust or inlet valve actuation and/or de-actuation) by alternating between at least two or more modes of operation (e.g. valve-lift modes). Such rocker arms typically involve multiple bodies, such as an inner arm and an outer arm. These bodies are latched together by a latching system comprising a movable latch pin to provide one mode of operation (e.g. a first valve-lift mode (e.g. normal engine combustion mode) and are unlatched, and hence can pivot with respect to each other, to provide a second mode of operation (e.g. a second valve-lift mode (e.g. valve de-activation mode). Typically, the movable latch pin is used and actuated and de-actuated to switch between the two modes of operation.

SUMMARY

In an embodiment, the present invention provides a valve train assembly, comprising: at least one dual body rocker arm comprising a first body, a second body, a latching arrangement configured to latch and unlatch the first body and the second body, the latching arrangement being biased to an unlatched configuration; and an actuator arrangement external to the rocker arm configured to control the latching arrangement, the actuator arrangement being configured so that a default setting thereof is to cause the latching arrangement to be in a latched configuration.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
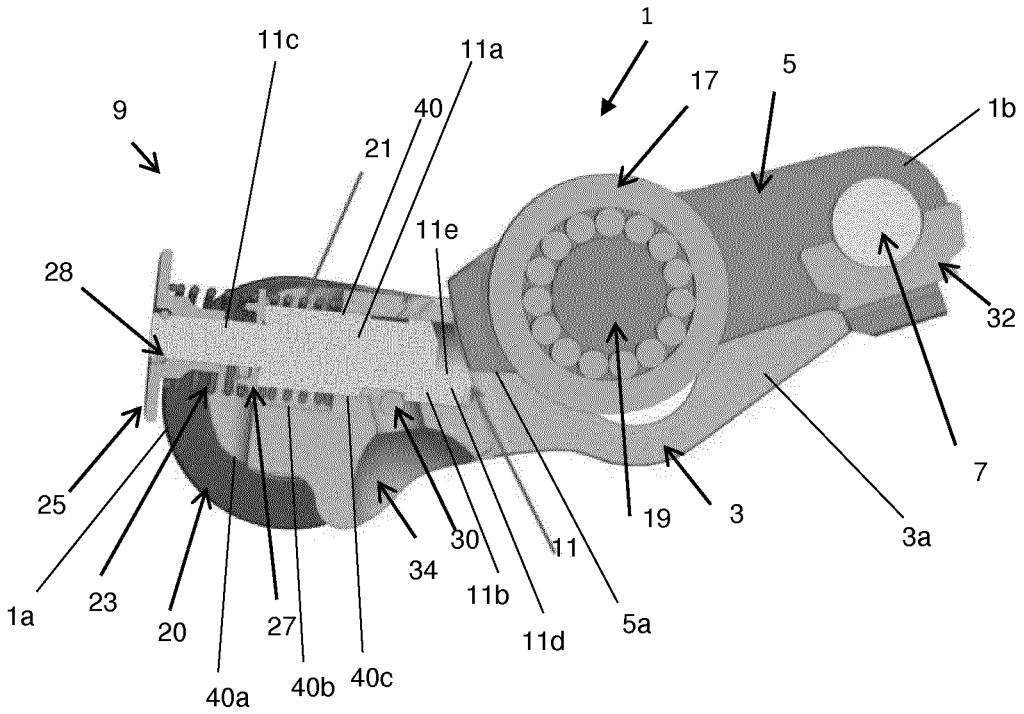
FIG. 1 illustrates a dual body rocker arm.

In an embodiment, the present invention provides a valve train assembly comprising at least one dual body rocker arm comprising a first body, a second body, a latching arrangement for latching and unlatching the first body and the second body and wherein the latching arrangement is biased to an unlatched configuration, the assembly further comprising an actuator arrangement external to the rocker arm for controlling the latching arrangement and wherein the actuator arrangement is configured so that its default setting is to cause the latching arrangement to be in a latched configuration.

The actuator arrangement may comprise and actuator and a shaft rotatable by the actuator, the shaft comprising a component for operating the latching arrangement.

The component may be a selector cam rotatable to operate the latching arrangement.

The selector cam may comprise a lobe profile and a base circle.

The actuator may be arranged to rotate the shaft between a first configuration in which the lobe profile acts on the latching arrangement causing the latching arrangement to be in the latched configuration and a second configuration in which the lobed profile does not act on the latching arrangement thereby allowing the latching arrangement to be in the unlatched configuration, the first configuration being the default setting of the actuator arrangement.

The actuator arrangement may comprise a biasing unit arranged to bias the shaft rotationally in a first direction towards the first configuration.

The actuator arrangement may comprise a hard stop arranged to prevent the shaft from rotating in the first direction beyond the first configuration.

The actuator arrangement may comprise a joint connector for connecting the actuator to the shaft.

The joint connector may comprise a slot defining a substantially flat contact surface for contacting a corresponding substantially flat surface of a drive shaft of the actuator.

In the latched configuration the latching arrangement may latch the first body and the second body together so that the rocker arm provides for a first primary function in use and in the unlatched configuration the first body and the second body may be unlatched so that the rocker arm provides for a second secondary function in use.

In the latched configuration the first body and the second body may be arranged to pivot as a single body about a first pivot point under the action of a cam in use, and in the unlatched configuration the first and second bodies may be arranged to pivot with respect to one another about a second pivot point under the action of the cam.

The second secondary function may be for cylinder deactivation.

The latching arrangement may comprise: a latch pin movable to between a latched configuration in which the latch pin latches the first and second bodies together and an unlatched configuration in which the first and second bodies are unlatched; a first biasing unit for biasing the latch pin to the unlatched configuration; a piston member; and a compliance biasing unit; and the piston member may be arranged so that if the actuator arrangement attempts to cause the latch pin to move from the unlatched configuration to the latched configuration at a time when the latch pin is prevented from being moved, the piston member moves to bias the compliance biasing unit so that the compliance biasing unit urges the latch pin to the latched configuration when the latch pin again becomes movable.

The latch pin may be slidably supported in a bore defined by one of the first body and the second body.

The valve train assembly may comprise a plurality of said rocker arms each comprising a said latching arrangement, and the actuator arrangement may be for controlling the latching arrangement of each rocker arm, and the actuator arrangement may be configured so that its default setting is to cause each latching arrangement to be in the latched configuration.

FIG. 1 illustrates a dual body rocker arm 1 comprising an outer body 3 and an inner body 5 that are pivotably connected together at a pivot axis 7. The rocker arm 1 further comprises at one end a latching arrangement 9 (which may be referred to as a compliance capsule) comprising a latch pin 11 slidably supported in a bore 40 in the outer body 3 and which can be urged between a first configuration (not shown in FIG. 1, but see e.g. FIG. 4) in which the latch pin 11 latches the outer body 3 and the inner body 5 together and a second configuration (shown in FIG. 1) in which the outer body 3 and the inner body 5 are un-latched.

In the first configuration, the outer body 3 and the inner body 5 are latched together and hence can move or pivot about a pivot point as a single body so that the that rocker arm 1 provides a first primary function, for example, an engine valve that it controls is activated as a result of the rocker arm 1 pivoting as a whole about a pivot point (e.g. about a Hydraulic lash adjuster) and exerting an opening force on the valve.

In the second configuration, the outer body 3 and the inner body 5 are un-latched so that the inner body 5, for example, can pivot freely with respect to the outer body 3 so that rocker arm 1 provides a second secondary function, for example, the valve it controls is de-activated (e.g. to provide cylinder de-activation) as a result of lost motion absorbed by the inner body 5 pivoting freely with respect to the outer body 3 and hence no opening force being applied to the valve.

The outer body 3 comprises two generally parallel side walls 3*a* (only one is visible in FIG. 1) which define a space which contains the inner body 3. The two side walls 3*a* are connected together at the first end 1*a* of the rocker arm 1.

The inner body 5 is provided with an inner body cam follower 17, in this example, a roller follower 17 rotatably mounted (for example with bearings) on an axle 19 for following an auxiliary cam profile on a cam shaft and the outer body 3 is provided with a pair of cam followers (not visible in FIG. 1), in this example, a pair of slider pads arranged either side of the roller follower 17 for following a pair of primary cam profiles mounted on the cam shaft.

The rocker arm 1 further comprises a return spring arrangement 20 for biasing the inner body 5 to its rest position after it is has pivoted with respect to the outer body 3.

The outer body 3 is provided, at a first end 1*a* of the rocker arm 1, with a recess 34 for receiving an end of a lash adjustor so that the rocker arm 1 is mounted for pivotal movement about the lash adjustor. The lash adjuster which may be supported in an engine block may, for example, be a hydraulic lash adjuster, and is used to accommodate slack (or lash) between components in an overall valve train assembly.

During engine operation when the rocker arm 1 is in the first configuration (i.e. where the inner body 5 and the outer body 3 are latched together by the latching arrangement 9) as the cam shaft rotates, a lift profile of the cam shaft engages the roller follower 17 exerting a force that causes the rocker arm 1 to pivot about the lash adjuster to push on the valve against the force of a valve return spring thus opening the valve. As the peak of the lift profile passes out of engagement with the roller follower 17 the valve return spring begins to close the valve and the rocker arm 1 pivots about the lash adjuster in the opposite sense to when the valve is opening. When a base circle of the cam engages the roller follower 17 the valve is fully closed and the valve lift event is complete.

During engine operation when the rocker arm 1 is in the second configuration (i.e. where the inner body 5 and the outer body 3 are not latched together, see e.g. FIG. 1) as the cam shaft rotates, the lift profile of the cam engages the roller follower 17 exerting a force that causes the inner body 5 to pivot relative to the outer body 3 about the pivot axis 7 from a first orientation that the inner body 5 adopts when the base circle engages the roller follower 17 to a second orientation that the inner body 5 adopts when the peak of the lift profile engages the roller follower 17. This movement of the inner body 5 relative to the outer body 3 'absorbs' as 'lost motion' the motion that would otherwise be transmitted from the cam to the valve and hence the valve remains closed. As the peak of the of the lift profile passes out of engagement with the roller follower 17 and subsequently the base circle of the cam engages the roller follower 17 again, the inner body 3 is urged by the lost motion return spring arrangement 20 from the second orientation back to the first orientation.

Figure 4:
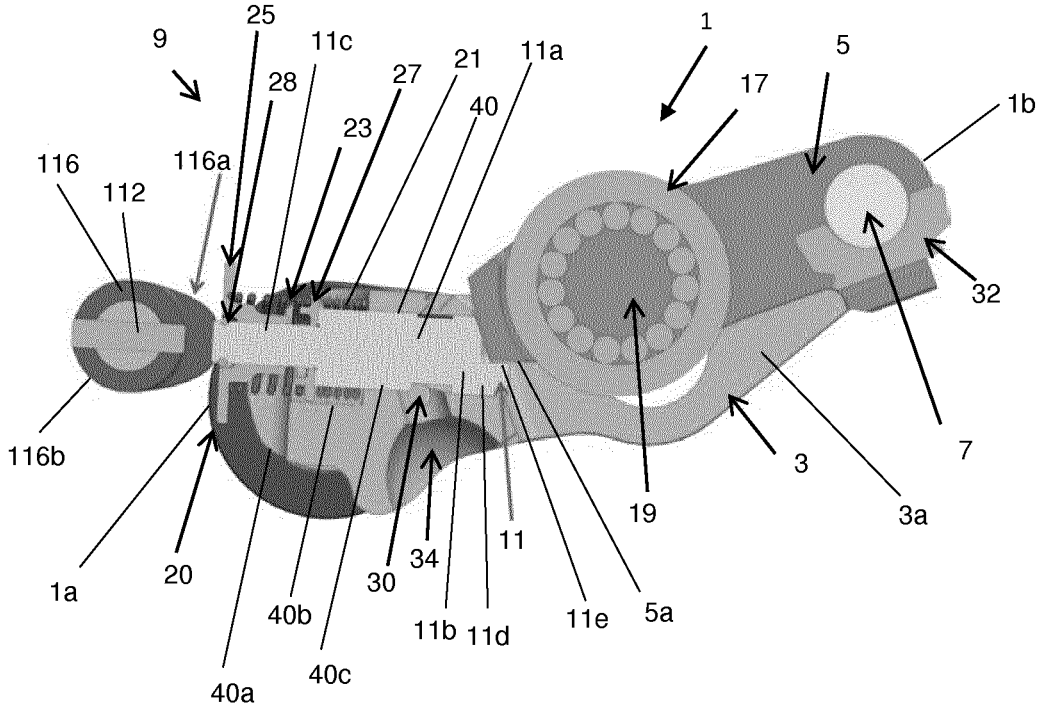
FIG. 4 illustrates a dual body rocker arm.

Hence, when the rocker arm 1 is in the first configuration (i.e. where the inner body 5 and the outer body 3 are latched together, see e.g. FIG. 4), the rocker arm 1 may be configured for a first primary function, for example a first mode of operation, for example a first valve lift mode, such as a main valve lift mode, for example for causing a normal valve event, and when the rocker arm 1 is in the second configuration (i.e. where the inner body 5 and the outer body 3 are unlatched, see e.g. FIG. 1), the rocker arm 1 may be configured for a second secondary function, for example a second mode of operation, for example a second valve lift mode, for example a cylinder deactivation valve lift mode, for example for causing cylinder deactivation.

The latching arrangement 9 is located at the first end 1*a* of the rocker arm 1. The first end 1*a* of the rocker arm 1 is opposite to a second end 1*b* of the rocker arm 1 at which the pivot axis 7 is located. The latch pin 11 is generally elongate and is located in the bore or channel 40 formed in the outer body 3 at the first end 1*a* of the rocker arm 1.

The latch arrangement 9 further comprises a first spring 21 (also called a return spring) on an inner section of the latch pin 11 that is arranged to bias the latch pin 11 away from the latched configuration.

The latch arrangement 9 may also comprise a second spring (a so-called compliance spring) 23 that is on an outer section of the latch pin 11 and is arranged between outer 25 and inner 27 (e.g. a spring washer) compliance spring retainer components, also referred to herein as a piston member 25 and a retainer ring 27, respectively.

In use, the compliance spring 23 is compressed if an actuator arrangement (described below) attempts to cause the latching pin to move into the latched position at a time when it cannot do so (e.g. because of the relative orientations of the inner and outer arms) so as to then cause the latching pin to move into the latched position when it becomes free to do so.

The dual body rocker arm further comprises a C clip 28, an orientation dowel pin 30 an elephant foot 32 (which may for example contact the valve to be operated, and a pivot point 34 for receiving a pivot support (e.g. a hydraulic lash adjuster).

In the illustrated example, the bore 40 in which the latching arrangement 9 is located, is a stepped bore and comprises a first section 40*a*, a second section 40*b* and a third section 40*c*. The first section 40*a* has an open end at the first end 1*a* of the rocker arm 1 and the third section 40*c* has an open end that faces the inner body 5. The second section 40*b* is between and connects the first section 40*a* and the third section 40*c*. The width (e.g. diameter) of the first section 40*a* is greater than the width of the second section 40*b* which is greater than width of the third section 40*c*.

The latch pin 11 comprises a main body portion 11*a*, a first end portion 11*b* and a second end portion 11*c*. The first end portion 11*b* faces the inner body 5 and comprises a lip section 11*d* that extends from the main body portion 11*a* and defines a latch pin contact surface 11*e*. The second end portion 11*c* is a shoulder portion of smaller diameter than the main body portion 11*a* and extends from the main body portion 11*a*.

The outer body 3 is shaped so the bore or channel 40 opens out or widens or flares at the first end 1*a* of the rocker arm 1 so that although at least a portion of the piston member 25 is within the bore or channel 40 (which provides for compactness) much of the piston member 25 is visible.

The piston member 25 is a hollow member that has a longitudinal aperture that is slightly wider than the second end portion 11*c* of the latch pin 11 (e.g. it has a slightly wider diameter) and which is mounted in sliding contact along substantially all of its length on the second end portion 11*c* of the latch pin 11. The C-clip or stopper ring 28, received in a notch formed around an outermost end of the second end portion 11*c* acts to limit the extent of the expansion stroke of the piston member 25.

The second end portion 11*c* also passes through an aperture of the retainer ring 27 which sits tightly on the second end portion 11*c* facing the piston member 25 and resting against the main body portion 11*a* of the latch pin 11. The compliance spring 23 is between a flared or flange end portion 25*a* of the piston 25 and the retainer ring 27. The return spring 21 sits around the main body portion 11*a* of the latch pin 11 between the retainer ring 27 and a part of the outer body 3.

The orientation pin 30 (e.g. a dowel pin) is provided to help maintain the orientation of the latch pin 11.

When it is required that the rocker arm 1 be in the latched configuration, for example to provide for a first valve lift mode, for example a normal valve opening mode, the actuation arrangement (not shown in FIG. 1 but see e.g. actuation arrangement 110 of FIGS. 2 to 5) may be oriented so as to apply a force to the piston member 25, inwards towards the inner body 5 (see e.g. FIG. 4).

The biasing or spring force (e.g. stiffness) of the compliance spring 23 is much higher than that of the return spring 21 and so accordingly the force of the actuation arrangement pushing on the piston member 25 is transmitted to the latch pin 11 through the compliance spring 23 as the piston member 25 moves in the first section of the bore 28 and the latch pin 11, which is free to move, is caused to move against the bias of the return spring 21 into a fully extended position in which it latches the inner body 5 and outer body 3 together. In this position, the contact surface 11*e* of the latch pin 11 engages a corresponding contact surface 5*a* of the inner body 5. This configuration is illustrated in FIG. 4. In this first (latched) configuration, the rocker arm 1 will function as previously described above in response to the rotating cam.

It is noted that if the actuator arrangement applies a force to the piston member 25 to try to cause the latch pin 11 to move from the fully retracted position (i.e. unlatched position) to the fully extended position (i.e. latched position) at a time when the latch pin 11 is unable to move (not illustrated), the actuator arrangement causes the piston member 25 to slide along the second end portion 11*c* of the latch pin to compress the compliance spring 23.

The latch pin 11 may be prevented from moving, for example, because for example, the inner body 5 is pivoted relative to the outer body 3 and has not yet returned to the position it adopts when the cam base circle is engaged with the roller follower 17. In such a case, the inner body 5 physically abuts the latch pin 11 and prevents it from moving into the latched position (not illustrated).

However, when the inner body 5 has completed its return stroke (i.e. it is back in the position it adopts when the cam base circle engages the roller follower 17) so that the latch pin 11 is free to move again, the force generated by the compressed compliance spring 23 as it de-compresses is stronger than the force required to overcome the return spring 21 and so causes the latch pin 11 to move into the fully extended position in which it latches the inner arm 5 and the outer arm 3 together (as illustrated in FIG. 4).

Advantageously, because the compliance spring 23 and piston member 25 arrangement will ensure that the latch pin 11 is moved into the latching position, there is no need to carefully control the timing of the actuator arrangement to be synchronous with the inner arm 5 ending its return stroke.

When it is required that the rocker arm 1 be in the unlatched configuration, for example to provide for a second valve lift mode, for example for cylinder deactivation, the actuation arrangement (not shown in FIG. 1 but see e.g. actuation arrangement 110 of FIGS. 2 to 5) may be controlled so as to apply substantially no force to the latching arrangement 9. In this case, the return spring 21 causes the latch pin 11 and the piston member 25 to return to the fully retracted position (as illustrated for example in FIG. 5).

Figure 2:
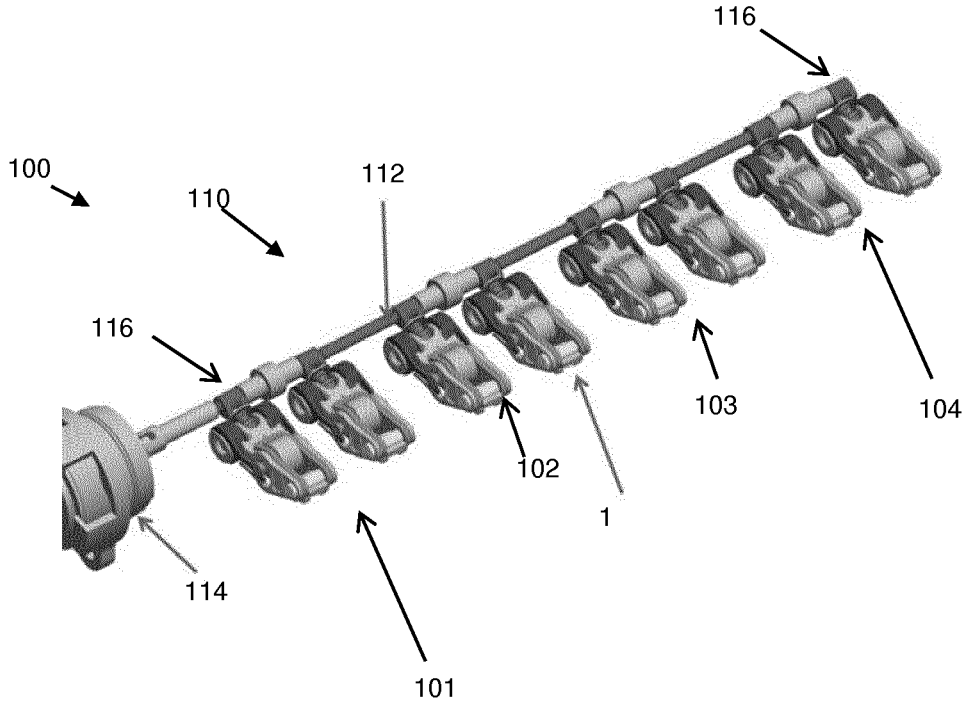
FIG. 2 illustrates an actuation system and dual body rocker arms.

Referring now to FIG. 2, there is illustrated a valve train assembly 100 comprising four pairs 101 to 104 of the rocker arms 1 and actuation arrangement 110 for operating the latching arrangements 9 of the rocker arms 1.

In this example, each respective pair of rocker arms 101 to 104 is for controlling a pair of valves (e.g. exhaust or inlet) on a respective cylinder of an engine (e.g. the arrangement relates to a 4 cylinder engine in this example).

Figure 5:
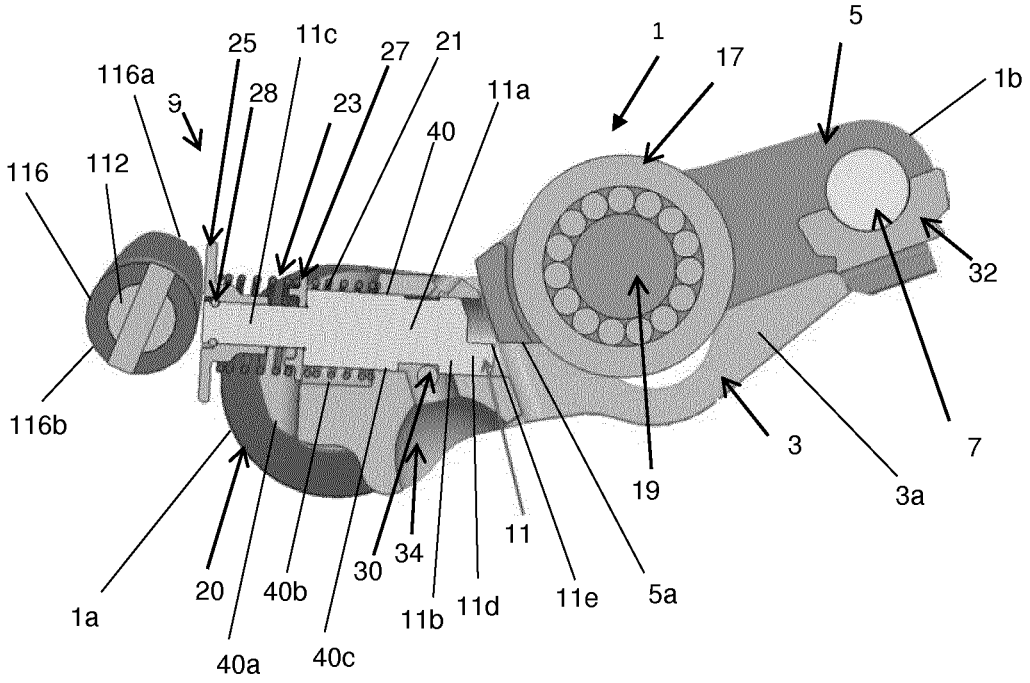
FIG. 5 illustrates a dual body rocker arm.

In this example, the actuation arrangement 110 comprises an elongate shaft 112 that is rotatable by an actuator 114, for example an electric motor. In another example, the actuator may be or comprise a hydraulic actuator, for example. The actuation arrangement 110 comprises a plurality of components, in this example, selector cams 116, one for each rocker arm 1, mounted on the shaft 112 for operating the latching arrangements 9. As best seen in FIGS. 4 and 5, each selector cam 116 comprises a lobe profile 116*a* and a base circle 116*b*.

The actuator 114 is able to move or rotate the shaft 112 between first and second configurations. In the first configuration, the cam lobe profiles 116*a* of the selector cams 116 push or act on the latching arrangements 9 (see e.g. FIG. 4) causing the latch pins 11 to be in the latched position, for example as described above. Specifically, when it is required that the rocker arms 1 be in the latched configuration, for example to provide for a first valve lift mode, the actuator 114 may orient the shaft 112 so that the lobe profile 116*a* of each respective selector cam 116 contacts the latching arrangement 9 of each respective rocker arm 1, for example to apply a force to each respective piston member 25. As described above, this may cause each respective latch pin 11 to be in the latched position (see FIG. 4). In the second configuration, the cam lobe profiles 116*a* of the selector cams 116 do not act on the latching arrangements 9 of the rocker arms 1 allowing the return springs 21 to cause the latch pins 11 to be in the un-latched position (see FIG. 5). Specifically, when it is required that the rocker arms 1 be in the unlatched configuration, for example to provide for a second valve lift mode, the actuator 114 may be controlled (for example by an engine management system) to rotate the shaft 112 so that a base circle portion 116*b* of each respective selector cam 116 faces towards the latching arrangement 9 (such that the lobed profile 116*a* of the cam 116 does not contact the latching arrangement 9). In this case, as described above, the return spring 21 causes the latch pin 11 to be in the unlatched position (see FIG. 5).

Figure 3:
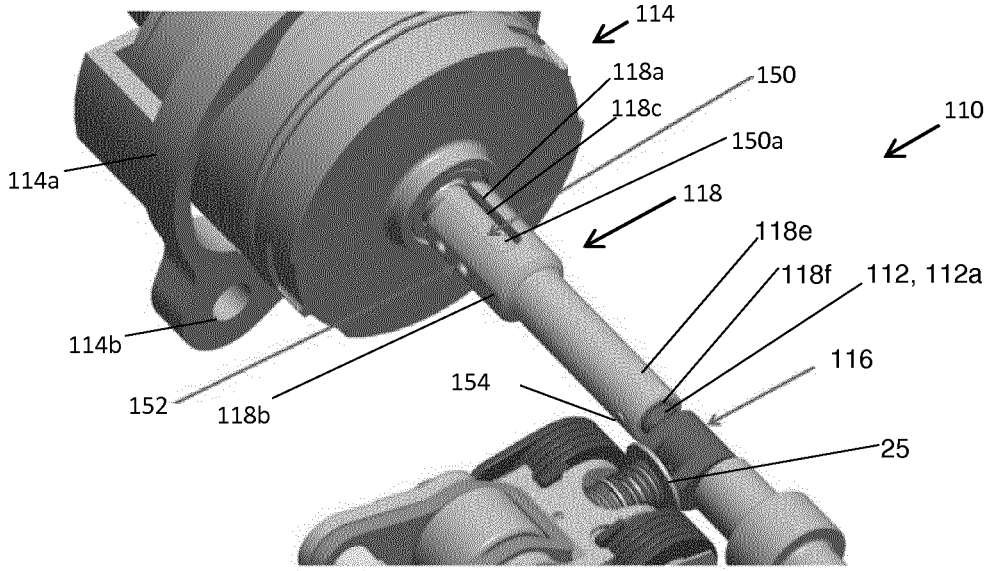
FIG. 3 illustrates part of the actuation system and a dual body rocker arm.

As shown in FIG. 3, the actuation arrangement 110 may comprises a joint connector 118 for connecting the actuator 114 to the shaft 112. Specifically, the actuator 114 comprises a drive shaft 150. The drive shaft 150 is elongate and controllable to rotate about its longitudinal axis.

A first end 150*a* of the drive shaft 150 defines a first and a second substantially flat surface (not visible in FIG. 3) on opposing sides of the drive shaft 150. The first end 150*a* of the drive shaft 150 is received into a corresponding slot 118*a* at a first end 118*b* of the connector 118. The slot 118*a* is defined at least in part a first and second opposing substantially flat surfaces (only one surface 118*c* is visible in FIG. 3) of the connector 118. The drive shaft 150 may be fixed to the connector 118 by a suitable fixing means 152, for example a threaded screw. The first and second flat surfaces of the drive shaft 150 contact the first and second 118*c* flat surfaces of the connector 118, respectively. This arrangement may help ensure that the rotational orientation of the drive shaft 150 remains fixed relative to the rotational orientation of the connector 118.

A second end 118*e* of the connector 118 defines a bore 118*f* into which a first end 112*a* of the shaft 112 is received. The shaft 112 may be fastened relative to the connector 118 by a suitable fixing means 154, such as a threaded screw. This may help ensure the rotational orientation of the shaft 112 remains fixed relative to the rotational orientation of the connector 118 (and hence of the drive shaft 150).

Advantageously, in this example, the default (e.g. fail safe) configuration of the actuation arrangement 110 is the first configuration in which the cam lobe profiles of the selector cams 116 act on the latching arrangements (see FIG. 4) causing the latch pins 11 to be in the latched position to ensure that the default ensures that the primary engine function (e.g. a main valve lift) is provided.

The default position may be ensured by the actuator itself for example and/or a torsional spring working together with a mechanical hard stop installed on the shaft 112 or any other suitable means.

Specifically, referring to FIG. 3, a body 114*a* of the actuator 114 may be fixed relative to an engine block for example, via connecting portions 114*b*. The actuator 114 may be arranged such that the drive shaft 150 has default, fail safe, or rest, rotational orientation with respect to the body 114*a* of the actuator 114. For example, the actuator may be arranged such that the drive shaft returns to the same, predetermined, rotational orientation with respect to the body 114*a* of the actuator 114 in default, for example when power is lost from the actuator 114, or for example when no control signals are received by the actuator 114 by an engine management system, for example due to a failure of the engine management system or a failure of the communication between the engine management system and the actuator 114, for example.

The actuation arrangement 110 may be configured such that this default rotational orientation is as illustrated in FIG. 3, where the shaft 112 is orientated such that each of the selector cams 116 have their lobed portions 116*a* in contact with the latching arrangements 9 of each rocker arm 1, and hence causing the latch pins 11 of each rocker arm 1 to be in the latched position, and hence causing each of the rocker arms 1 to be in the latched configuration. As mentioned above, rocker arms 1 that are in the latched configuration may provide for a first primary function, such as a main valve lift. Accordingly, even when power is lost to the actuator 114, or a communication between the engine management system and the actuator 114 has failed, for example, the primary engine function may still be provided. This may help improve reliability.

Moreover, because the compliance spring 23 and piston member 25 arrangement will ensure that the latch pin 11 is moved into the latching position the next time it is possible for the latch pin 11 to do so, the rotation of the shaft 150 to the default first configuration (causing default latching of the rocker arms 1) need not be carefully timed to be synchronous with the inner arm 5 ending its return stroke. This may help ensure that the primary engine function is provided regardless of the timing of the default condition, for example regardless of the timing of power loss to the actuator 114, or of a communication between the engine management system and the actuator 114 failing. This may help improve reliability.

As mentioned above, the default position may be ensured by the actuator 114 itself. For example, the actuator 114 may comprise a hard stop, for example fixed relative to the body 114*a* of the actuator 114. The hard stop may be arranged to prevent the drive shaft 150 from rotating in a first direction beyond a certain degree, for example from rotating beyond the default rotational orientation in a first rotational direction. The actuator 114 may also comprise a biasing unit, for example a torsional spring arranged around the drive shaft 150, arranged to bias the drive shaft 150 rotationally in the first direction towards the default position, for example towards the hard stop. The actuator 114 may be controllable (for example by an engine management system) to cause the drive shaft to rotate (for example by electromagnetic or hydraulic means) in a second direction (opposite to the first direction) against the biasing unit, for example to cause the shaft 112 to rotate into the second configuration (which may cause the rocker arms 1 to be in the unlatched configuration). In default, for example the actuator is not controlled or where power to the actuator 114 fails, for example, the biasing unit will cause the drive shaft 150 to rotate in the first direction to the hard stop and hence cause the drive shaft 150 (and hence the shaft 112) to return to the default position or configuration (which may cause the rocker arms 1 to be in the latched configuration).

In other examples, instead of being provided as part of the actuator 114 itself, the hard stop and and/or the biasing unit may be employed as part of the connector 118 and/or the shaft 112, in a similar way as for the drive shaft 150 described above.

The rocker arm 1 may provide for any switchable valve operating mode, for example an exhaust deactivation mode, variable valve timing mode, exhaust gas recirculation mode, compression brake mode etc.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A valve train assembly, comprising:

at least one dual body rocker arm comprising a first body, a second body, and a bore defined by at least one of the first body and the second body;

a latching arrangement configured to latch and unlatch the first body and the second body, the latching arrangement being biased to an unlatched configuration, the latching arrangement comprising:

a latch pin;

a first biasing unit configured to bias the latch pin to unlatch the first body and the second body;

a piston member slidable along the latch pin;

a compliance biasing unit mounted against the piston member; and a retainer ring seated against the first biasing unit and the compliance basing unit, the retainer ring seated in the bore of the dual body rocker arm; and an actuator arrangement external to the dual body rocker arm configured to control the latching arrangement, the actuator arrangement being configured so that a default setting thereof is to cause the latching arrangement to be in a latched configuration.

2. The valve train assembly according to claim 1, wherein the actuator arrangement comprises an actuator and a shaft rotatable by the actuator, the shaft comprising a component configured to operate the latching arrangement.

3. The valve train assembly according to claim 2, wherein the component comprises a selector cam rotatable to operate the latching arrangement.

4. The valve train assembly according to claim 3, wherein the selector cam comprises a lobe profile and a base circle.

5. The valve train assembly according to claim 4, wherein the actuator is arranged to rotate the shaft between a first configuration in which the lobe profile acts on the latching arrangement causing the latching arrangement to be in the latched configuration, and a second configuration in which the lobe profile does not act on the latching arrangement thereby allowing the latching arrangement to be in the unlatched configuration, the first configuration being the default setting of the actuator arrangement.

6. The valve train assembly according to claim 2, wherein the actuator arrangement comprises a joint connector configured to connect the actuator to the shaft.

7. The valve train assembly according to claim 6, wherein the joint connector comprises a slot defining a substantially flat contact surface configured to contact a corresponding substantially flat contact surface of a drive shaft of the actuator.

8. The valve train assembly according to claim 1, wherein in the latched configuration the latching arrangement latches the first body and the second body together so that the rocker arm provides for a first primary function in use, and wherein in the unlatched configuration the first body and the second body are unlatched so that the rocker arm provides for a second secondary function in use.

9. The valve train assembly according to claim 8, wherein in the latched configuration the first body and the second body are configured to pivot as a single body about a first pivot point under an action of a cam in use, and in the unlatched configuration the first and second bodies are configured to pivot with respect to one another about a second pivot point under the action of the cam.

10. The valve train assembly according to claim 8, wherein the second secondary function is for cylinder deactivation.

11. The valve train assembly according to claim 1, wherein the piston member is configured so that when the actuator arrangement applies a force to the latch pin to move from the unlatched configuration to the latched configuration at a time when the latch pin is prevented from being moved, the piston member moves to bias the compliance biasing unit so that the compliance biasing unit urges the latch pin to the latched configuration when the latch pin becomes movable.

12. The valve train assembly according to claim 1, wherein the latch pin is slidably supported in the bore.

13. The valve train assembly according to claim 1, wherein the valve train assembly comprises a plurality of the at least one dual body rocker arm, and wherein the actuator arrangement is configured to control the latching arrangement of each at least one dual body rocker arm.

14. A switchable rocker arm, comprising:

a first body comprising a bore;

a second body; and a latching arrangement configured to latch and unlatch the first body and the second body, the latching arrangement comprising:

a latch pin;

a return spring configured to bias the latch pin to unlatch the first body and the second body;

a piston member slidable along the latch pin;

a compliance spring mounted against the piston member; and a retainer ring seated against the return spring and the compliance spring, the retainer ring seated on the latch pin, and the retainer ring seated in the bore.

15. The switchable rocker arm of claim 14, wherein the piston member comprises:

a longitudinal aperture mounted in sliding contact on the latch pin; and a flange end portion abutting the compliance spring.

16. The switchable rocker arm of claim 14, further comprising a stopper ring on the latch pin, the stopper ring configured to limit slidable travel of the piston member.

17. The switchable rocker arm of claim 14, wherein the piston member is slidable with the bore.

18. The switchable rocker arm of claim 14, wherein the return spring is within the bore.

19. The switchable rocker arm of claim 18, wherein the compliance spring is within the bore.

20. A valve train assembly, comprising:

a switchable rocker arm, comprising:

a first body;

a second body; and a bore in one of the first body and the second body; and a latching arrangement configured to latch and unlatch the first body and the second body, the latching arrangement comprising:

a latch pin;

a return spring configured to bias the latch pin to unlatch the first body and the second body;

a piston member slidable along the latch pin;

a compliance spring mounted against the slidablc piston member; and a retainer ring seated against the return spring and the compliance spring, the retainer ring seated on the latch pin, and the retainer ring seated in the bore; and an actuator arrangement comprising an actuator and a rotatable shaft, the rotatable shaft comprising selector cams for actuating the latching arrangement.

* * * * *